US005896792A

United States Patent [19]

Hurt

[11] Patent Number: 5,896,792

[45] Date of Patent: Apr. 27, 1999

[54] HOLDER FOR SOCKET WRENCH

[76] Inventor: Jon Hurt, 1512 E. Everett, Orange, Calif. 92867

[21] Appl. No.: 08/966,626

[22] Filed: Nov. 10, 1997

[51] Int. Cl.[6] ..... B25B 13/06

[52] U.S. Cl. ..... 81/125; 81/451

[58] Field of Search ..... 81/125, 451

[56] References Cited

U.S. PATENT DOCUMENTS

| | | | |
|---|---|---|---|
| D. 327,960 | 7/1992 | Uke . | |
| 3,916,736 | 11/1975 | Clemens . | |
| 4,112,988 | 9/1978 | Nelson | 81/125 X |
| 4,809,421 | 3/1989 | Justice . | |
| 4,836,067 | 6/1989 | Rogers et al. . | |
| 4,880,344 | 11/1989 | Henry et al. . | |
| 4,979,355 | 12/1990 | Ulevich . | |
| 5,116,242 | 5/1992 | Scotti . | |
| 5,311,060 | 5/1994 | Bostoker et al. . | |
| 5,323,673 | 6/1994 | Martinez et al. . | |
| 5,452,904 | 9/1995 | Huber et al. . | |

*Primary Examiner*—James G. Smith
*Attorney, Agent, or Firm*—James G. O'Neill

[57] ABSTRACT

A thin, flexible, plastic holder is formed and placed between a socket extension and the drive end of a socket and/or a bolt or nut and the interior of the socket. The drive end of the socket extension is forced into the drive end of the socket with a first enlarged head of the holder deformed therebetween, while the head of a bolt or a nut is forced into the interior of the socket, with a second enlarged head of the holder deformed therebetween, so as to more securely hold the extension and head of the bolt or the nut in the socket.

17 Claims, 1 Drawing Sheet

10
12
17
14
16

10A
14

12
16

26
16
22
24
14
18
28
12
20
10
30

16
10

26
18
14
30

HOLDER FOR SOCKET WRENCH

BACKGROUND OF THE INVENTION

1. Field of the Invention

This invention relates generally to holders for nuts and bolts, and, more particularly, to a flexible, throw-away holding means for holding bolts, nuts, and extensions in sockets.

2. Description of the Prior Art

Socket wrenches and sockets are widely used in homes and in industry. Additionally, when using sockets to insert nuts and bolts in hard to reach places various size and length extensions for must be used. However, because of wear and other factors, many nuts and bolts, as well as the driving end of the extensions used with the sockets, are loosely held therein, and such nuts or bolts may fall out of the sockets, or be incorrectly started, causing delays and other problems. Therefore, various adapters and holders have been devised to hold nuts and bolts in position in sockets.

One type of nut and bolt holder for sockets is set forth in U.S. Pat. No. 5,323,675 to Martinez et al., which discloses legs, beams, cams and resilient means for holding a nut or bolt in a socket. However, the holding means disclosed in this patent are complicated, expensive to manufacture, and are limited for use in the specific socket to which the specific holding means has been secured.

Other known means for holding nuts and bolts in sockets include magnets placed in the sockets to hold a nut or bolt therein, or adapters or inserts placed in specific sockets to adapt such sockets to a specific size, or to protect the finish of a bolt or nut being driven by the socket. Examples of such devices are illustrated by U.S. Pat. Nos. 3,916,736 to Clemmens, 4,836,067 to Rogers et al., and 4,979,355 to Ulevich.

Other means, such as shims or tightening means, are known for use in adjusting the spacing between items. Examples of such shims, etc. are disclosed in U.S. Pat. Nos. 4,809,421 to Justice, 4,880,344 to Henry et al., 5,116,242 to Scotti, 5,311,060 to Rostoker, 5,452,904 to Huber et al., and Design 327,960 to Uke.

While the foregoing described prior art holding means for sockets, as well as shims and tightening means for other items, have provided limited improvements, and overcome some of the problems connected with the need for holding nuts and bolts together, or for adjusting the space between items, they usually have very limited application, tend to be complicated and expensive to manufacture, and are designed for permanent use with specific sockets, or the like. Therefore, after many attempts to solve the problem of devising holding means for use with sockets to hold nuts and bolts in position, and to insure accurate placement thereof, there still exists the need in the art for a simple, easy to use and manufacture, low cost, disposable holding means for use with sockets.

SUMMARY OF THE INVENTION

Accordingly, it is a general object of the present invention to provide an improved holding means for a socket. It is a particular object of the present invention to provide an improved holding means for holding nuts and bolts in a socket. It is a still more particular object of the present invention to provide an improved holding means comprising a thin, resilient, plastic strip of material that may be adapted to be used both with nuts and bolts and extensions to more securely hold them in sockets. It is yet a further particular object of the present invention to provide an improved holding means to keep nuts, bolts and extensions in sockets, which holding means are made from a thin, flexible plastic, and which may be discarded after use.

In accordance with one embodiment of the present invention, there is provided a thin, elongated, flexible, plastic element having a body with two ends and an enlarged flexible head at each of the two ends. One of the enlarged heads may be inserted between a nut or bolt, and the interior of a socket, to firmly hold the nut or bolt between the enlarged flexible head and the interior surface of the socket. The other enlarged flexible head may be inserted between a drive portion of a socket extension and a socket drive hole, to insure that the extension is firmly held within the socket drive hole. One of the enlarged flexible heads may be provided with a slit so as to be slipped over the shank of the extension, if not used to more securely hold the extension in the socket drive hole.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENT

Figure 1:
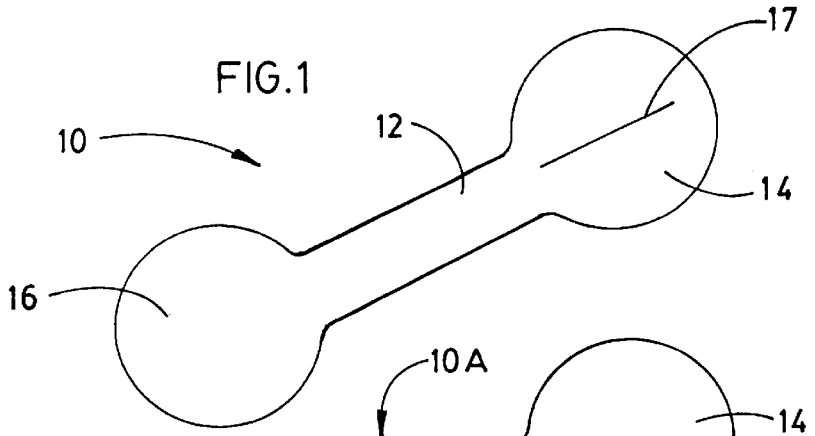
FIG. 1 is a top plan view of a first embodiment of the holding means of the present invention.
Figure 2:
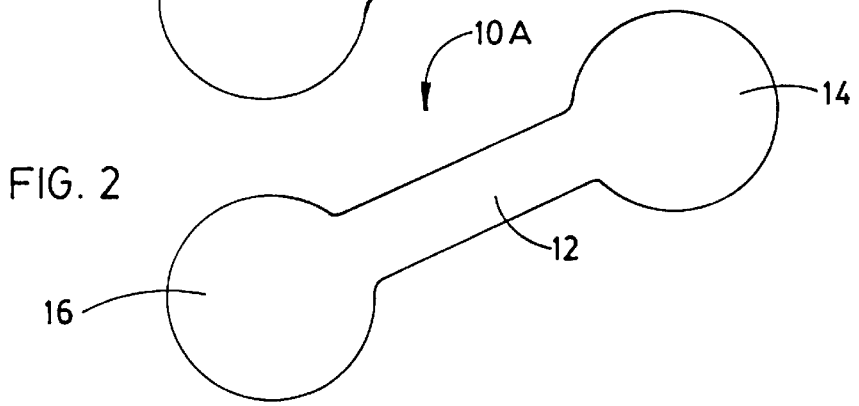
FIG. 2 is a top plan view of a further embodiment of a holding means of the present invention.

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for a general description of a holding means 10. The holding means 10 is preferably constructed by known fabrication techniques from a thin, resilient, and pliable, but fairly high strength, plastic, such as polyethylene. The body of the holding means may have any desired thickness, but is preferably of from about 2.5 to about 3 thousandths of an inch thick. The holding means 10 includes an elongated body having a narrow central portion 12 and a pair of enlarged, flexible heads 14, 16 which may be of any desired cross-section. The enlarged flexible heads 14, 16 may be of different or equal sizes. As shown most clearly in FIG. 1, one of the enlarged heads, such as 14, may be provided with a slit 17. The slit 17 allows the enlarged head 14 to be slipped over the shank of an extension, such as 18, if it is not desired or required that a squared drive end 20 of the extension have a further holding means used therewith, as described more fully below.

Figure 3:
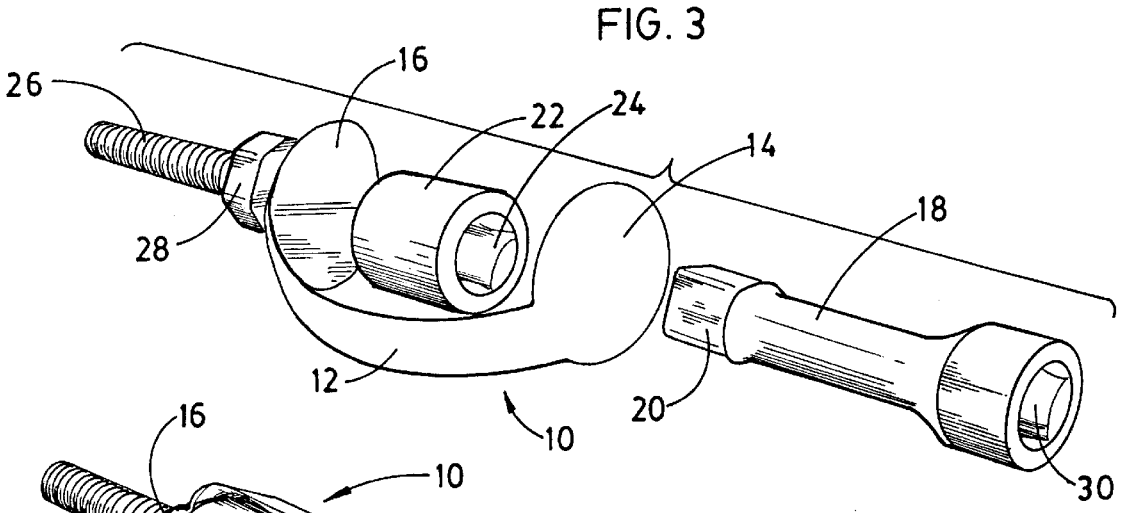
FIG. 3 is an exploded perspective view showing a bolt, a holding means, a socket and a socket extension drive.
Figure 4:
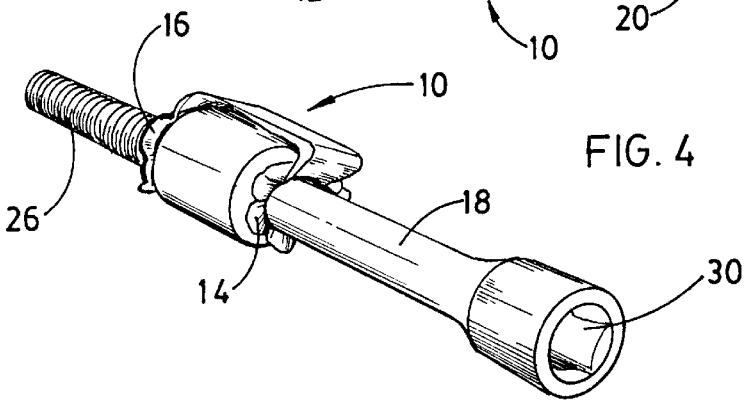
FIG. 4 is a further perspective view showing the socket extension, socket holding means and bolt head secured together in tight engagement, because of the flexible holding means inserted between the bolt head and the square drive end of the socket extension.

Each of the enlarged ends 14, 16 is shown as being substantially thin, and circular in cross-section. However, it is to be understood that these enlarged ends may have any desired cross-section, and/or may be provided with indicia, such as a square or octagonal shape formed thereon. The cross-section of the enlarged heads are sized and dimensioned so that they may be used with any size socket, in the positions shown in FIGS. 3 and 4. That is, in use, the enlarged heads 14, 16 must accommodate a square drive end 20 of the extension 18 when inserted into a drive opening 24 in a socket 22. That is, the material in the enlarged head 14 must be large enough to be captured therebetween, as shown in FIG. 4. In this manner, the square end 20 of extension 18 will be firmly and tightly held in opening 24 by the deformed, flexible, material of enlarged head 14.

Additionally, the enlarged head 16 of holding means 10 must be of sufficient size so as to firmly hold a head 28 of a bolt 26 (or a nut, not shown) in position, when inserted in the interior of the drive portion of the socket 22. Although the interior of the drive portion is not shown, it's shape is well known to those skilled in the art. The flexible, deformable, enlarged head 16 is stretched when the head 28 of bolt 26 is inserted in the interior of the drive portion of the socket 22, and acts as a holding mean or shim to firmly hold the bolt head in an aligned position in the socket. It is to be understood, that instead of a bolt 26 having an enlarged head 28, a nut, or the like, could also be securely held in the drive portion of socket 22 after being inserted therein so as to deform the enlarged head 16. After the nut or bolt has been driven by the socket 22, to install or remove the same, either the socket 22 or the nut or bolt is removed, and the deformed holding means 10, discarded or thrown-away.

In use, with a nut or bolt 26 held in position in the socket, by a deformed, enlarged head of holding means 10, a socket wrench attached to the outer drive end 30 of extension 18 may be used to drive the socket and extension to more easily install or secure the nut or bolt, into or out of hard to reach places. As explained above, the holding element 10 would most probably be discarded and not be used again, since the forcing of the bolt head 28 and drive end 20 into mating engagement would deform the enlarged heads, beyond their elastic limits, rendering them useless after removal.

It therefore, can be seen that the holding means 10 of the present invention may be easily manufactured, as by being stamped out from a thin polyethylene sheet, and used to more securely hold an extension in a socket, and a bolt head or nut in the interior of a socket. After use in removing and/or starting of the thread of a bolt into an opening or a nut onto a thread, the holding means 10 may be discarded.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A holding means for a standard socket used with a standard socket wrench, to aid the socket wrench user in the installation and removal of nuts and bolts, comprised of:

a substantially thin, flexible, plastic holder sized and shaped to fit within a socket cavity and to hold a bolt or nut inserted into the socket cavity;

the thin, flexible, plastic holder having an elongated central portion and two ends, with a first enlarged head formed at one of the two ends and a second enlarged head formed at a second of the two ends; and the first enlarged head adapted to be placed in the socket cavity and to hold a bolt head or nut inserted into the socket cavity so as to grip the bolt head or nut, and securely hold the same In the socket cavity.

2. The holding means of claim 1, further including a socket extension insertable into a socket drive cavity of the socket, and wherein the second enlarged head is sized and shaped to be held within the socket drive cavity between a squared driving portion of the socket extension and the socket drive cavity, to more securely hold the socket extension within the socket drive cavity.

3. The holding means of claim 1 wherein the second enlarged head includes a slot formed therein for mounting over an elongated shank portion of a socket extension to support the holding means thereon.

4. The holding means of claim 1 wherein the first enlarged head and the second enlarged head are substantially circular in cross-section and are of equal size.

5. The holding means of claim 4, further including a socket extension insertable into a socket drive portion of the socket, and wherein the second enlarged head is adapted to be held between a squared driving portion of the socket extension and the socket drive portion to more securely hold the socket extension within the socket drive portion.

6. The holding means of claim 5 wherein the substantially thin, flexible, plastic holder is between about 2.5 and about 3.0 thousandths of an inch thick.

7. The holding means of claim 1 wherein the first enlarged head and the second enlarged head are identically shaped, but are different in size.

8. The holding means of claim 7, further including a socket extension insertable into a socket drive portion of the socket, and wherein the second enlarged head is adapted to be held between a squared driving portion of the socket extension and the socket drive portion to more securely hold the socket extension within the socket drive portion.

9. The holding means of claim 8 wherein the substantially thin, flexible, plastic holder is between about 2.5 and about 3.0 thousandths of an inch thick.

10. A method for securing a nut and a bolt within a socket comprising the steps of:

providing a thin, flexible, plastic holder having an elongated central portion and a pair of enlarged heads;

placing one of the pair of enlarged heads between the head of a bolt or a nut and a socket drive portion; and forcing the head of the bolt or the nut into an interior portion of the socket drive portion with the one of the pair of enlarged heads held therebetween, to deform the one of the pair of enlarged heads and hold the head of the bolt or the nut in the interior portion of the socket drive portion.

11. The method of claim 10, comprising the further step of placing a second of the pair of enlarged heads between a driving portion of a socket extension and a drive hole formed in the socket; and forcing the driving portion of the socket extension into the drive hole of the socket so as to deform the second of the pair of enlarged heads and securely hold the drive head of the socket extension within the drive hole of the socket.

12. The method of claim 11 wherein the thin, flexible, plastic holder is formed between about 2.5 and about 3.0 thousandths of an inch thick.

13. A holding means for holding a socket drive extension in a socket, and a nut or a bolt in the socket; the holding means comprising;

an elongated, thin, flexible body with a central portion having a first end and a second end;

a first enlarged head portion secured to the first end, and a second enlarged head portion secured to the second end;

the first enlarged head portion being sized and shaped to fit within a socket cavity to hold a nut or a bolt inserted into the socket cavity, with the first enlarged head portion captured between the nut or bolt and the socket cavity; and the second enlarged head portion being sized and shaped to fit within a socket drive opening between a drive end of the socket drive extension inserted into the socket drive opening, by the deformation of the second enlarged head portion captured between the drive end and the socket drive opening.

14. The holding means of claim 13 wherein the first enlarged head portion and the second enlarged head portion are of different shapes.

15. The holding means of claim 13 wherein the first enlarged head portion and the second enlarged head portion are substantially circular.

16. The holding means of claim 15 wherein the first enlarged head portion and the second enlarged head portion are different in size.

17. The holding means of claim 13 wherein the first enlarged head portion and the second enlarged head portion are between about 2.5 and about 3.0 thousandths of an inch thick.

* * * * *